United States Patent [19]

Lohmann

[11] B 4,001,138

[45] Jan. 4, 1977

[54] STABLE SOLUTIONS OF FLUORESCENT BRIGHTENERS

[75] Inventor: Frank Lohmann, Arlesheim, Switzerland

[73] Assignee: Ciba-Geigy Corporation, Ardsley, N.Y.

[22] Filed: Nov. 29, 1974

[21] Appl. No.: 528,297

[44] Published under the second Trial Voluntary Protest Program on March 16, 1976 as document No. B 528,297.

[30] Foreign Application Priority Data

Dec. 19, 1973 Switzerland ..... 17811/73

[52] U.S. Cl. .....252/301.27; 427/158; 260/309.2

[51] Int. Cl.[2] ..... C09K 11/00; C07D 231/54; D06L 3/12

[58] Field of Search ..... 252/301.2 R, 301.2 W; 117/33.5 T

[56] References Cited

UNITED STATES PATENTS

| | | | |
|---|---|---|---|
| 3,649,633 | 3/1972 | Mingasson et al. | 260/281 |
| 3,757,010 | 9/1973 | Balzer et al. | 260/240 B |
| 3,776,905 | 12/1973 | Zweidler et al. | 260/240.1 |
| 3,849,331 | 11/1974 | Mingasson et al. | 252/301.2 W |

*Primary Examiner*—John H. Mack
*Assistant Examiner*—Aaron Weisstuch
*Attorney, Agent, or Firm*—Joseph G. Kolodny; Edward McC. Roberts; Prabodh I. Almaula

[57] ABSTRACT

A stable weakly acid or neutral solution of quaternized fluorescent brighteners consisting essentially of a quaternized fluorescent brightener of the formula

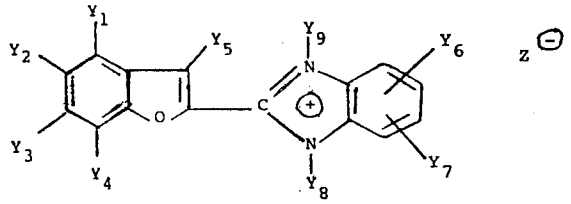

wherein $Y_1$ represents hydrogen methyl, ethyl, methoxy, halogen or together with $Y_2$ represents a fused benzene ring, $Y_2$ represents hydrogen, methyl, ethyl, methoxy, halogen or together with $Y_1$ or $Y_3$ represents a fused benzene ring, $Y_3$ represents hydrogen, methyl, ethyl, alkoxy with 1 to 4 carbon atoms, halogen or together with $Y_2$ or $Y_4$ represents a fused benzene ring, $Y_4$ represents hydrogen, alkyl with 1 to 4 carbon atoms, methoxy, halogen or together with $Y_3$ represents a fused benzene ring, $Y_5$ represents hydrogen, alkyl with 1 to 4 carbon atoms or phenyl which is unsubstituted or substituted by methyl and/or methoxy, $Y_6$ represents hydrogen, alkyl with 1 to 4 carbon atoms, alkylsulphonyl with 1 to 4 carbon atoms, methoxy or halogen, $Y_7$ represents hydrogen, methyl, methoxy or halogen, $Y_8$ represents alkyl with 1 to 4 carbon atoms, hydroxyalkyl with 2 to 4 carbon atoms, cyanoethyl, phenyl, cyclohexyl or benzyl which is unsubstituted or substituted by chlorine, methyl or methoxy, $Y_9$ represents alkyl with 1 to 4 carbon atoms which is unsubstituted or substituted by hydroxy or alkoxy with 1 to 4 carbon atoms, benzyl which is unsubstituted or substituted by chlorine or methoxy or represents a radical $-CH_2CN$, $-CH_2CONH_2$ or $-CH_2COOR$, wherein R represents an alkyl group with 1 to 4 carbon atoms, and Z represents halogen, an alkylsulphate with 1 to 4 carbon atoms or a phenylsulphonyl radical which is unsubstituted or substituted by methyl and, in the case of the weakly acid solution, a polar organic compound, water and a weak acid, and, in the case of the neutral solution, a polar, aprotic organic compound and water.

11 Claims, No Drawings

STABLE SOLUTIONS OF FLUORESCENT BRIGHTENERS

The application of commercial products in the form of solutions makes it possible to avoid the drawbacks that the application of commercial products in solid form frequently entails. Such drawbacks include dusting, insufficient fluidity, poor automatic addition and inadequate rate of dissolving. Solutions of cationic fluorescent brighteners are commercially available which contain substantial amounts of strong mineral acids, thereby limiting the advantage of the liquid marketed form because of the necessary safety precautions involved in the use of strong acids.

The present invention provides weakly acid or neutral stable solutions of quaternised fluorescents which are completely miscible with water and which contain a quaternised fluorescent brightener and, in the case of the weakly acid solution, a polar organic compound, water and a weak acid, and, in the case of the neutral solution, a polar, aprotic organic compound and water.

It is advantageous to use those polar organic compounds which are readily water-soluble or are miscible with water.

Suitable polar organic compounds are primarily glycols and ethers thereof, e.g. 2-methylpentane-2,4-diol and ethylene glycol monoalkyl ethers with 1 to 4 carbon atoms, e.g ethylene glycol mono-n-butyl ether, polyglycols and ethers thereof, water-soluble ketones and alcohols, e.g. diacetone alcohol, and water-soluble amides, e.g. urea, formamide and dimethyl formamide.

It is advisable to use those solvents which have a low volatility and/or as high flash and ignition points as possible so that no problems arise in handling the formulations.

Of preeminent interest is the use of urea, since it is possible to manufacture therewith solutions which are particularly stable at low temperatures.

By weak acids are meant those with a $pK_a$ higher than 1.8. Water-soluble carboxylic acids are therefore preferably used. Examples of water-soluble carboxylic acids are monocarboxylic or dicarboxylic acids, especially aliphatic mono- or dicarboxylic acids with at least 2 carbon atoms, e.g. acetic acid, propionic acid, glycolic acid, maleic acid, lactic acid.

Polar, aprotic organic compounds which are used for manufacturing the neutral solutions are above all propylene carbonate, ethylene carbonate, tetramethylene sulphone, dimethyl sulphone, dimethyl sulphoxide and especially γ-butyrolactone.

Quaternised fluorescent brighteners with a particularly interesting utility are quaternisation products of pyrazolines, naphthalimides, imidazoles (e.g. derivatives of benzimidazol-(2)-yl-2-benzofuran, 5-phenyl-2-benzimidazol-(2)-yl-furan or derivatives of coumarins with imidazole radicals in 3- and/or 7-position) or triazoles (e.g. derivatives of coumarins with triazole radicals in 3- and/or 7-position) with quaternisable tertiary nitrogen atoms, as well as oxacyanine derivatives.

To be highlighted in this connection are the imidazole derivatives of the formula (1)

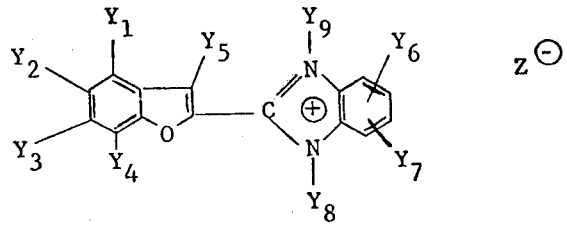

wherein $Y_1$ represents hydrogen, methyl, ethyl, methoxy, halogen or together with $Y_2$ represents a fused benzene ring, $Y_2$ represents hydrogen, methyl, ethyl, methoxy, halogen or together with $Y_1$ or $Y_3$ represents a fused benzene ring, $Y_3$ represents hydrogen, methyl, ethyl, alkoxy with 1 to 4 carbon atoms, halogen or together with $Y_2$ or $Y_4$ represents a fused benzene ring, $Y_4$ represents hydrogen, alkyl with 1 to 4 carbon atoms, methoxy, halogen or together with $Y_3$ represents a fused benzene ring, $Y_5$ represents hydrogen, alkyl with 1 to 4 carbon atoms or phenyl which is optionally substituted by methyl and/or methoxy, $Y_6$ represents hydrogen, alkyl with 1 to 4 carbon atoms, alkylsulphonyl with 1 to 4 carbon atoms, methoxy or halogen, $Y_7$ represents hydrogen, methyl, methoxy or halogen, $Y_8$ represents alkyl with 1 to 4 carbon atoms, hydroxyalkyl with 2 to 4 carbon atoms, cyanoethyl, phenyl, cyclohexyl or benzyl which is optionally substituted by chlorine, methyl or methoxy, $Y_9$ represents alkyl with 1 to 4 carbon atoms which is optionally substituted by hydroxy or alkoxy with 1 to 4 carbon atoms, benzyl which is optionally substituted by chlorine or methoxy or represents a radical $-CH_2CN$, $-CH_2CONH_2$ or $-CH_2COOR$, wherein R represents an alkyl group with 1 to 4 carbon atoms, and Z represents halogen, an alkylsulphate with 1 to 4 carbon atoms or a phenylsulphonyl radical which is optionally substituted by methyl.

Quaternised fluorescent brighteners within the scope of the formula (1) which are preferably used have the formula (2)

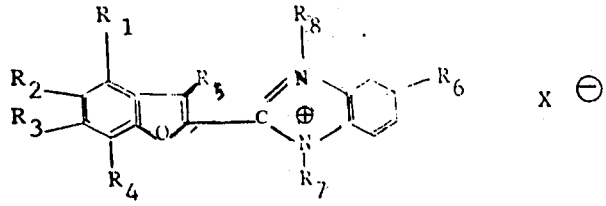

wherein either each of $R_1$, $R_2$ and $R_4$ independently represents hydrogen, methyl or chlorine and $R_3$ represents methoxy, or $R_1$ and $R_2$ together represent a fused benzene ring and $R_3$ and $R_4$ represent hydrogen, $R_5$ represents hydrogen or methyl, $R_6$ represents hydrogen, methyl, methoxy, chlorine, methylsulphonyl or ethylsulphonyl, $R_7$ represents methyl, phenyl or benzyl, $R_8$ represents methyl or benzyl and X represents chlorine, the methylsulphate or the p-toluenesulphonyl radical.

Particularly interesting compounds within the scope of the formula (2) are those of the formula (3)

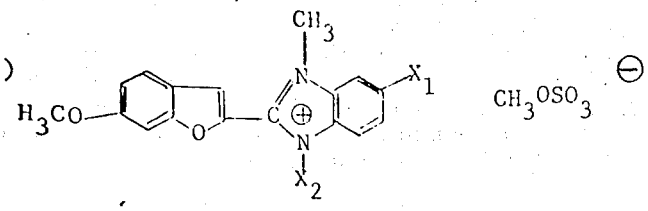

wherein $X_1$ represents hydrogen or methylsulphonyl and $X_2$ represents methyl or benzyl.

The solutions can of course also contain mixtures of two or more polar organic compounds, mixtures of two or more polar, aprotic organic compounds or mixtures of two or more quaternised fluorescent brighteners.

The weakly acid solutions contain as a rule a. 10 to 40 percent by weight, preferably 10 to 30 percent by weight, of at least a quaternised brightener, b. 15 to 60 percent by weight, preferably 20 to 50 percent by weight, of at least a polar organic compound, c. 10 to 40 percent by weight, preferably 15 to 30 percent by weight, of water and d. 10 to 50 percent by weight, preferably 15 to 40 percent by weight, of a weak acid.

The neutral solutions normally contain a. 10 to 40 percent by weight, preferably 10 to 30 percent by weight, of a quaternised fluorescent brightener, b. 20 to 70 percent by weight, preferably 30 to 50 percent by weight, of a polar, aprotic organic compound, and c. 20 to 60 percent by weight, preferably 30 to 50 percent by weight, of water.

The procedure for manufacturing the solutions consists, for example, in dissolving the salts of the fluorescent brighteners, e.g. of a brightener of the formula (1), at normal or elevated temperature, in the already previously prepared mixture of organic polar compound/water/acid or organic, polar aprotic compound-/water. The solutions according to the invention are still fluid even at low temperatures, to some extent up to well below the freezing point, and the dissolved fluorescent brighteners do not crystallise.

The solutions according to the invention are miscible with water in any ratio or, if desired, with suitable organic solvents. This permits the brightener to be added in exact volumetric amounts. The solutions according to the invention are used primarily for the manufacture of fluorescent brightener liquors for textile fibres.

EXAMPLE 1

With stirring, 20 g of 1-benzyl-6-methoxybenzofuran-2-yl)-3-methyl-benzimidazolium methosulphate are dissolved between 20° and 50°C in 80 g of a solvent which contains 35 percent of urea, 30 percent of acetic acid (100 percent) and 35 percent of water. The solution is stable up to −10°C, of low viscosity and can be diluted with water to an unlimited extent.

EXAMPLE 2

With stirring, 20 g of 1-benzyl-2-(6-methoxybenzofuran-2-yl)-3-methyl-benzimidazolium methosulphate are dissolved at 40°C in 80 g of a solvent which contains 40 percent of urea, 35 percent of glycolic acid and 25 percent of water, to give a solution of low viscosity which is stable up to +4°C and which can be diluted with water to an unlimited extent.

EXAMPLE 3

With stirring, 20 g of 1-benzyl-2-(6-methoxybenzofuran-2-yl)-3-methyl-benzimidazolium methosulphate are dissolved between 15° and 50°C in 80 g of a solvent which contains 28 percent of glycolic acid, 20 percent of ethylene glycol mono-n-butyl ether, 30 percent of urea and 22 percent of water. A solution of low viscosity is obtained which, on being cooled, is stable up to −2°C and can be diluted with water to an unlimited extent.

EXAMPLE 4

With stirring, 20g of 1-benzyl-2-(6-methoxybenzofuran-2-yl)-3-methyl-benzimidazolium methosulphate are dissolved at room temperature in 80 g of a solvent which contains 21 percent of glycolic acid, 30 percent of ethylene glycol mono-n-butyl ether, 30 percent of urea and 19 percent of water. A clear solution is obtained which, on being cooled, is stable up to 0°C. If the 30 percent urea is replaced by ethylene glycol mono-n-butyl-ether, then a complete solution of the brightener is possible only at temperatures above 20°–25°C. The necessary stability at low temperatures up to 0°C is lost.

EXAMPLE 5

15 g of 1,3-dimethyl-5-sulphomethyl-2-(6-methoxybenzofuran-2-yl)-benzimidazolium methosulphate are dissolved in 85 g of the solvent used in and under the conditions of Example 1. A solution of low viscosity is obtained which is stable at low temperatures and which can be readily diluted with water.

EXAMPLE 6

With stirring, 20 g of 1-benzyl-2-(6-methoxybenzofuran-2-yl)-3-methyl-benzimidazolium methosulphate are dissolved at 30°C in 80 g of a solvent which contains 50 percent of glycolic acid, 30 percent of 2-methylpentane-2,4-diol and 20 percent of water. The formulation is stable on storage up to +2°C.

EXAMPLE 7

With stirring, 15 g of 1-benzyl-2-(6-methoxybenzofuran-2-yl)-3-methyl-benzimidazolium methosulphate are dissolved at 40°C in 85 g of a solvent which contains 40 percent of glycolic acid, 30 percent of diacetone alcohol and 30 percent of water, to give a formulation which is stable on storage.

EXAMPLE 8

20 g of 1-benzyl-2-(6-methoxybenzofuran-2-yl)-3-methylbenzimidazolium methosulphate are dissolved at room temperature in 80 g of a mixture which contains equal parts by weight of γ-butyrolactone and water.

EXAMPLE 9

20 g of 1,3-dimethyl-5-sulphomethyl-2-(6-methoxybenzofuran-2-yl)-benzimidazolium methosulphate are dissolved in 80 g of the solvent used in and under the conditions of Example 8.

EXAMPLE 10

15 g of 1-[4-(N'-methyl-N'-β-oxyethyl-piperazin-N-yliumsulphonyl)-phenyl]-3-(4-chlorophenyl)-pyrazoline-methosulphate are dissolved in a mixture of 50 g of γ-butyrolactone and 35 g of water. A solution of good storage stability is obtained.

I claim:

1. A stable acid or neutral solution of quaternised fluorescent brighteners consisting essentially of a quaternised fluorescent brightener of the formula

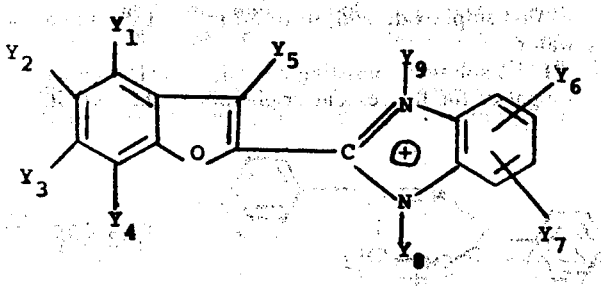

wherein $Y_1$ represents hydrogen, methyl, ethyl, methoxy, halogen or together with $Y_2$ represents a fused benzene ring, $Y_2$ represents hydrogen, methyl, ethyl, methoxy, halogen or together with $Y_1$ or $Y_3$ represents a fused benzene ring, $Y_3$ represents hydrogen, methyl, ethyl, alkoxy with 1 to 4 carbon atoms, halogen or together with $Y_2$ or $Y_4$ represents a fused benzene ring, $Y_4$ represents hydrogen, alkyl with 1 to 4 carbon atoms, methoxy, halogen or together with $Y_3$ represents a fused benzene ring, $Y_5$ represents hydrogen, alkyl with 1 to 4 carbon atoms or phenyl which is unsubstituted or substituted by at least one of methyl or methoxy, $Y_6$ represents hydrogen, alkyl with 1 to 4 carbon atoms, alkylsulphonyl with 1 to 4 carbon atoms, methoxy or halogen, $Y_7$ represents hydrogen, methyl, methoxy or halogen, $Y_8$ represents alkyl with 1 to 4 carbon atoms, hydroxyalkyl with 2 to 4 carbon atoms, cyanoethyl, phenyl, cyclohexyl or benzyl which is unsubstituted or substituted by chlorine, methyl or methoxy, $Y_9$ represents alkyl with 1 to 4 carbon atoms which is unsubstituted or substituted by hydroxy or alkoxy with 1 to 4 carbon atoms, benzyl which is unsubstituted or substituted by chlorine or methoxy or represents a radical $-CH_2CN$, $-CH_2CONH_2$ or $-CH_2COOR$, wherein R represents an alkyl group with 1 to 4 carbon atoms, and Z represents halogen, an alkylsulphate with 1 to 4 carbon atoms or a phenylsulphonyl radical which is unsubstituted or substituted by methyl and, in the case of the weakly acid solution, a polar organic compound, water and a weak acid, and, in the case of the neutral solution, a polar, aprotic organic compound and water.

2. A weakly acid solution according to claim 1 consisting essentially of a. 10 to 40 percent by weight of said quaternised fluorescent brightener, b. 15 to 60 percent by weight of a polar organic compound, c. 10 to 40 percent by weight of water and d. 10 to 50 percent by weight of a weak acid.

3. A solution according to claim 2 wherein the polar organic compound is urea, ethylene glycol mono-n-butyl ether, 2-methylpentane-2,4-diol or diacetone alcohol or mixtures of these compounds, and the weak acid is acetic acid, glycolic acid or a mixture thereof.

4. A neutral solution according to claim 1 which consists essentially of a. 10 to 40 percent by weight of said quaternised fluorescent brightener, b. 20 to 70 percent by weight of an organic, polar aprotic compound and c. 20 to 60 percent by weight of water.

5. A solution according to claim 1 wherein the polar organic compound is urea, ethylene glycol mono-n-butyl ether, 2-methylpentane-2,4-diol or diacetone alcohol or mixtures of these compounds, and the weak acid is acetic acid, glycolic acid or a mixture thereof.

6. A solution according to claim 5 wherein the quaternised fluorescent brightener is a compound of the formula

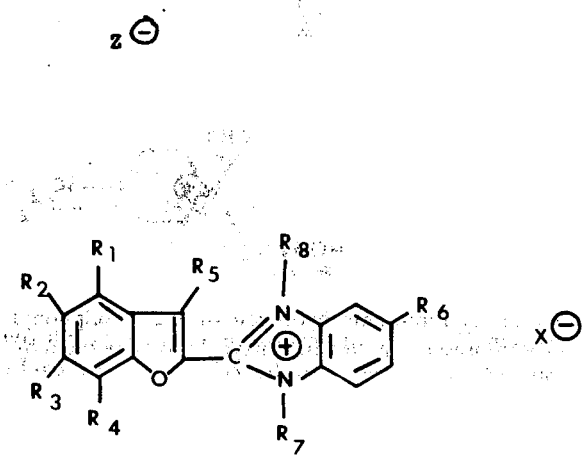

wherein either of $R_1$, $R_2$ and $R_4$ independently represents hydrogen, methyl or chlorine and $R_3$ represents methoxy, or $R_1$ and $R_2$ together represent a fused benzene ring and $R_3$ and $R_4$ represent hydrogen, $R_5$ represents hydrogen, methyl, methoxy, chlorine, methylsulphonyl or ethylsulphonyl, $R_6$ represents hydrogen, methyl, methoxy, chlorine, methylsulphonyl or ethylsulphonyl, $R_7$ represents methyl, phenyl or benzyl, $R_8$ represents methyl or benzyl and X represents chlorine, the methosulphate or the p-toluenesulphonyl radical.

7. A solution according to claim 1 wherein the polar, aprotic organic compound is propylene carbonate, ethylene carbonate, γ-butyrolactone, tetramethylsulphone, dimethylsulphone or dimethyl sulphoxide or mixtures thereof.

8. A solution to claim 7 wherein the quaternised fluorescent brightener is a compound of the formula

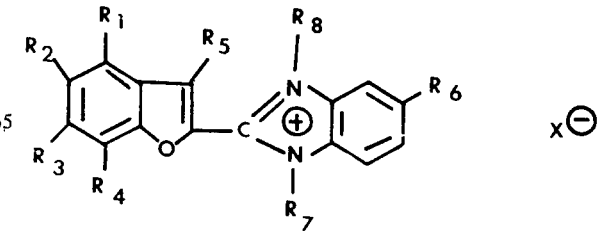

wherein either of $R_1$, $R_2$ and $R_4$ independently represents hydrogen, methyl or chlorine and $R_3$ represents methoxy, or $R_1$ and $R_2$ together represent a fused benzene ring and $R_3$ and $R_4$ represent hydrogen, $R_5$ represents hydrogen, methyl, methoxy, chlorine, methylsulphonyl or ethylsulphonyl, $R_6$ represents hydrogen, methyl, methoxy, chlorine, methylsulphonyl or ethylsulphonyl, $R_7$ represents methyl, phenyl or benzyl, $R_8$ represents methyl or benzyl and X represents chlorine, the methosulphate or the p-toluene-sulphonyl radical.

9. A solution according to claim 1 consisting essentially of 10 to 30 percent by weight of a quaternised fluorescent brightener of the formula

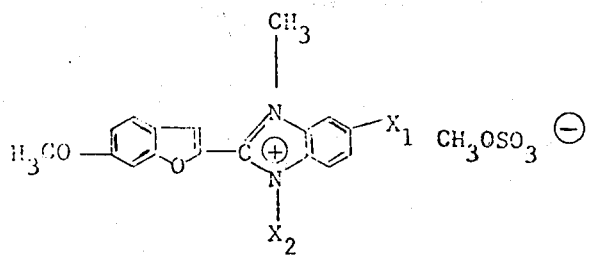

wherein $X_1$ represents hydrogen or methylsulphonyl and $X_2$ represents methyl or benzyl, 20 to 50 percent by weight of a compound of the group consisting of urea, ethylene glycol mono-n-butyl ether, 2-methylpentane-2,4-diol and diacetone alcohol, 15 to 30 percent by weight of water and 15 to 40 percent by weight of acetic acid, glycolic acid, or a mixture thereof.

10. A solution according to claim 1 consisting essentially of 10 to 30 percent by weight of a quaternised fluorescent brightener of the formula

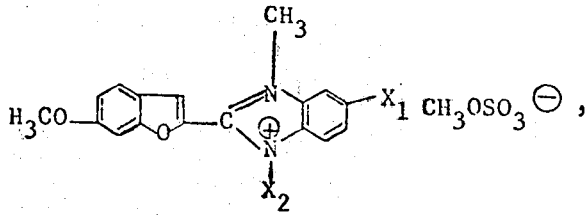

wherein $X_1$ represents hydrogen or methylsulphonyl and $X_2$ represents methyl or benzyl, 30 to 50 percent by weight of a compound of the group consisting of propylene carbonate, ethylene carbonate, γ-butyrolactone, tetramethylsulphone, dimethylsulphone and dimethyl sulphoxide and 30 to 50 percent by weight of water.

11. A solution consisting essentially of 15 percent by weight of the fluorescent brightener of the formula

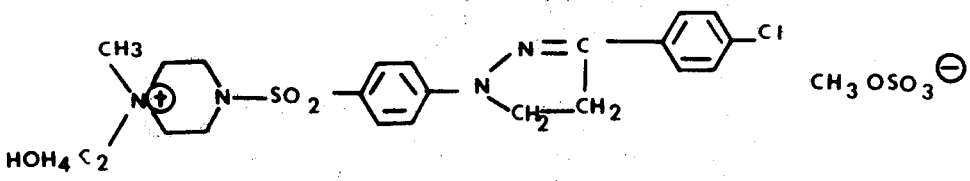

50 percent by weight of γ-butyrolactone and 35 percent by weight of water.

* * * * *